US011918102B2

(12) United States Patent
Sommer

(10) Patent No.: US 11,918,102 B2
(45) Date of Patent: Mar. 5, 2024

(54) CUSTOMIZABLE HAIRBRUSH

(71) Applicant: Goody Products, Inc., Atlanta, GA (US)

(72) Inventor: Henry David Sommer, Lawrenceville, GA (US)

(73) Assignee: Goody Products, Inc., Commack, NY (US)

( * ) Notice: Subject to any disclaimer, the term of this patent is extended or adjusted under 35 U.S.C. 154(b) by 400 days.

(21) Appl. No.: 17/224,104

(22) Filed: Apr. 6, 2021

(65) Prior Publication Data

US 2022/0312946 A1 Oct. 6, 2022

(51) Int. Cl.

| | |
|---|---|
| ***A46B 7/04*** | (2006.01) |
| ***A46B 5/00*** | (2006.01) |
| ***A46B 9/02*** | (2006.01) |

(52) U.S. Cl.

CPC ..... *A46B 7/042* (2013.01); *A46B 5/0095* (2013.01); *A46B 9/023* (2013.01); *A46B 2200/104* (2013.01)

(58) Field of Classification Search

CPC ... A46B 7/042; A46B 2200/104; A46B 9/023; A46B 5/0095; A46B 9/02

See application file for complete search history.

(56) References Cited

U.S. PATENT DOCUMENTS

| | | | | |
|---|---|---|---|---|
| 898,467 | A | 9/1908 | Hanaway | |
| 1,586,751 | A | 6/1926 | Kellogg | |
| 2,238,603 | A | 4/1941 | Runnels | |
| 3,491,777 | A | 1/1970 | Grosbard | |
| 4,118,823 | A | 10/1978 | Axelrod | |
| 5,771,904 | A | 6/1998 | Lange et al. | |
| 6,098,233 | A | 8/2000 | Chen | |
| 6,477,732 | B1 | 11/2002 | Cline et al. | |
| 10,028,574 | B2 | 7/2018 | Rennette | |
| 2004/0177462 | A1 | 9/2004 | Brown et al. | |
| 2011/0056505 | A1 | 3/2011 | Parkinson et al. | |
| 2012/0090118 | A1 * | 4/2012 | Lambertson, Jr. ..... | A46B 9/06 15/190 |

FOREIGN PATENT DOCUMENTS

| | | |
|---|---|---|
| CN | 110731605 A | 1/2020 |
| CN | 110934408 A | 3/2020 |

(Continued)

OTHER PUBLICATIONS

PCT Search Report and Written Opinion for PCT/US22/21900, USPTO Searching Authority, dated Jul. 12, 2022.

*Primary Examiner* — Andrew A Horton

(74) *Attorney, Agent, or Firm* — Gloria Tsui-Yip; Gottlieb, Rackman & Reisman, P.C.

(57) ABSTRACT

A hairbrush may include a head portion, a handle extending from the head portion, and a cushion selectively coupleable with the head portion. The cushion is configured to be selectively loaded with one or more bristle bars, and each bristle bar may contain one or more bristles extending therefrom.

The cushion may include a plurality of bristle openings arranged in rows. Each row of bristle openings can be loaded with no bristle bars, one bristle bar, or two bristle bars. When a row of openings in the cushion is loaded with two bristle bars, the two bristle bars are interlocked with one another along their respective lengths.

20 Claims, 17 Drawing Sheets

(56) References Cited

FOREIGN PATENT DOCUMENTS

| | | | |
|---|---|---|---|
| EP | 0635222 | A2 | 1/1995 |
| GB | 510731 | A | 8/1939 |
| GB | 2300118 | A | 10/1996 |
| JP | 6046528 | U | 6/1994 |
| JP | 2015-130976 | A | 7/2015 |
| KR | 200487321 | Y1 | 9/2018 |
| WO | WO2013172454 | A1 | 11/2013 |
| WO | WO2015/161922 | A1 | 10/2015 |
| WO | WO2016/162825 | A1 | 10/2016 |
| WO | WO2017/079762 | A9 | 5/2017 |

* cited by examiner

CUSTOMIZABLE HAIRBRUSH

TECHNICAL FIELD

The present invention relates to a hairbrush, and more particularly, to a customizable hairbrush having a removable cushion that can be configured to receive a different number and/or types of bristles in each row of the cushion.

DISCUSSION OF THE RELATED ART

The marketplace abounds with different types of hairbrushes. Many of them have a traditional non-customizable configuration, but some are customizable. Known customization mechanisms typically involve detaching the entire head portion from a brush handle and replacing it with a different kind of a brush head. Other customizable hairbrush configurations feature a removable cushion with bristles permanently attached thereto. In this case, the cushion can be detached together with the bristles, and can be replaced with a different cushion featuring different bristles.

Thus, when a user desires to change his or her hair style, the user may replace the entire hairbrush head or just the cushion part of the brush with one that is most suitable for the user's specific hair styling needs. A professional hairdresser would need to stock a relatively large number of different hairbrush heads or cushions with different bristles in order to serve a clientele with diverse hair types and/or styles.

However, replacement of the entire brush head or even of the cushion with bristles is not an economical practice because of the large expenditure associated with purchasing numerous brush heads and/or cushions with bristles. In addition, many of the brush heads or cushions would be stored away for the vast majority of time since a user can utilize only one at a time, unnecessarily requiring a large amount of storage space.

SUMMARY

It is an object of the present invention to provide a highly customizable hairbrush. The novelty of the hairbrush specifically relates to the fact that the bristles in each row of a cushion of the hairbrush can be customized as needed due to the configuration of the cushion and the configuration of bristle bars which can be selectively coupled with the cushion (the bristle bars contain bristles for brushing hair).

Each row of openings in the cushion can be loaded with one bristle bar or with two bristle bars. Each bristle bar extends the entire length of a row of openings, and may have bristles occupying every other opening in a row of openings.

Importantly, the bristle bars of the present invention are interlockable with one another along their respective lengths. Therefore, when two bristle bars are loaded into the same row of openings, the bristle bars are interlocked with one another. The interlocking configuration of the bristle bars permits the individual bristles of one bristle bar to be arranged in-line with the individual bristles of the other interlocked bristle bar such that the two bristle bars together can form a straight row of bristles. Thus, two adjacent and interlocked bristle bars can fill the same row of bristle openings in the cushion.

Different bristle bars can also have different bristles, but a compatible interlocking configuration with one another. Therefore, a user can change not only the total number of bristles per row in the cushion by loading one or two bristle bars in each row of openings, but a user can load two different bars of bristles in the same row to modify the types of bristles arranged along the same row.

Of course, one or more rows of openings in the cushion can also be left empty (e.g., without bristles). Therefore, when the cushion includes a plurality of rows of bristle openings, a user can customize the hairbrush by selecting—for each row of openings in the cushion—whether to leave the row unoccupied by bristles, whether the row will be loaded with one bristle bar, or whether the row will be loaded with two interlocked bristle bars.

This results in a highly configurable hairbrush that permits customization of the bristles within each row of openings in the cushion.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
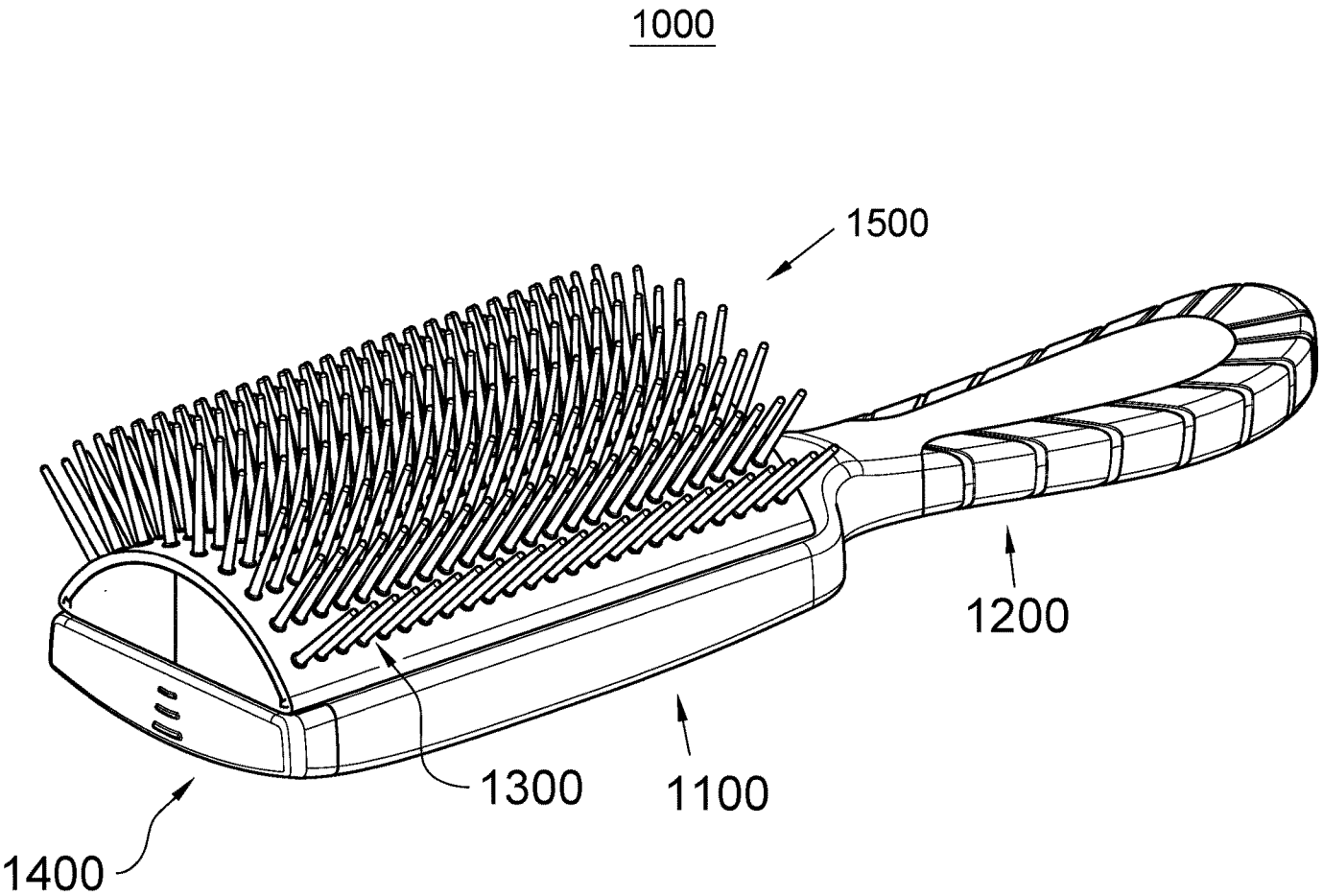
FIG. 1 is a perspective view illustrating a hairbrush according to an exemplary embodiment of the present invention.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

FIGS. 1-12 illustrate a hairbrush 1000 according to an exemplary embodiment of the present invention. Referring to FIGS. 1-12, and more specifically, to FIG. 1, the hairbrush 1000 may include a head portion 1100, a handle portion 1200, a cushion 1300, an end cap 1400 and a plurality of bristle bars 1500.

The hairbrush 1000 is primarily intended for use on human hair, but it can also be utilized for other purposes such as, for example, but not limited to, styling wigs (whether with natural or artificial hair), styling a doll's hair, grooming an animal's fur, brushing natural and/or synthetic fibers prior to being spun into a yarn, etc.

As can be gleaned with reference to FIGS. 1-4, the cushion 1300 is selectively connected to the head portion 1100. This enables the cushion 1300 to be detached from the head portion 1100 when needed in order to change a configuration of bristles of the hairbrush 1000. This will be described in detail below.

Figure 2:
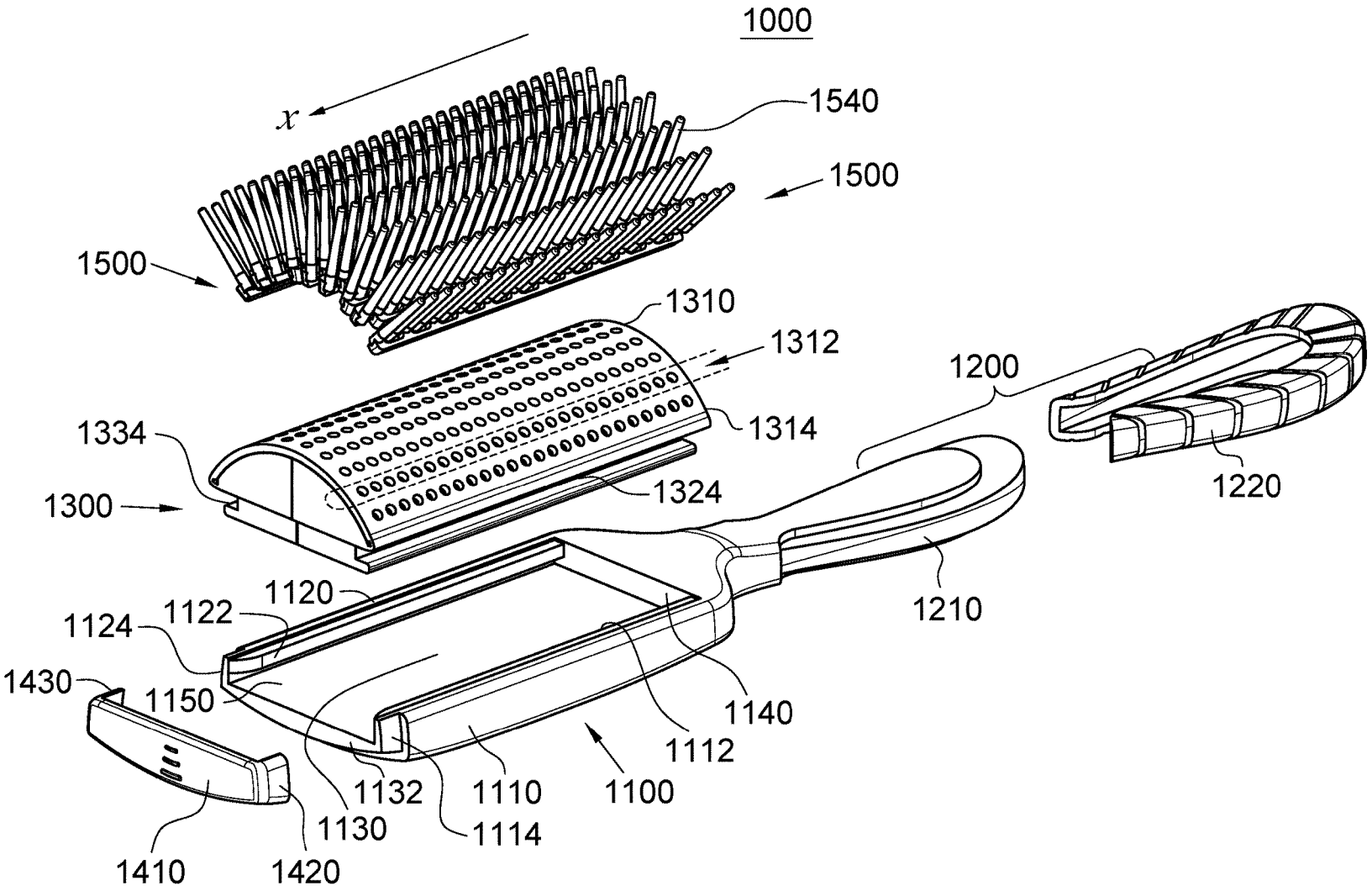
FIG. 2 is an exploded perspective view illustrating the hairbrush of FIG. 1.
Figure 4:
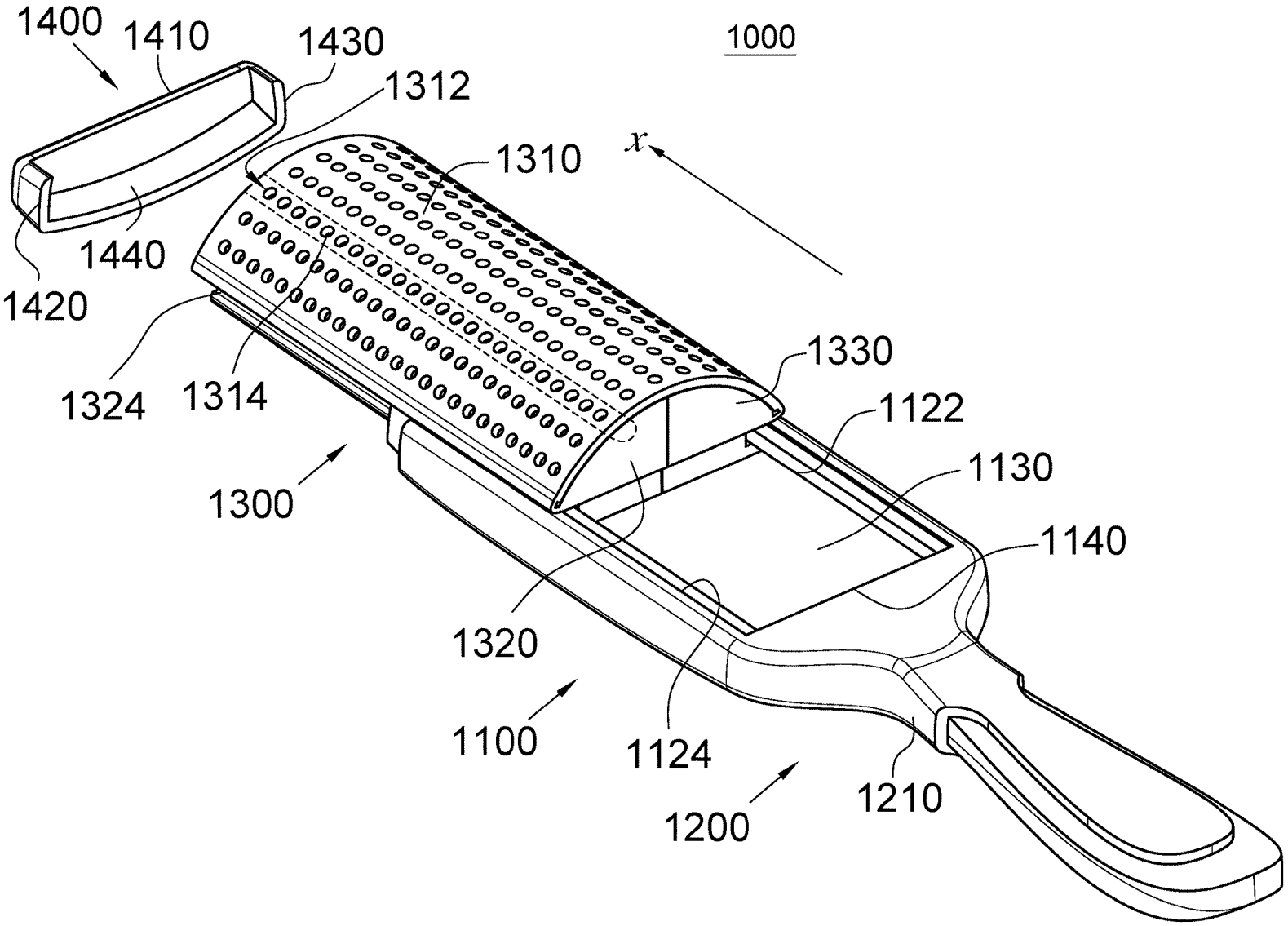
FIG. 4 is a perspective view illustrating the hairbrush of FIG. 1 without bristles.

Referring to FIGS. 2 and 4, the head portion 1100 extends in a first, axial, direction X and includes a first sidewall 1110, a second sidewall 1120 opposite to the first sidewall 1110 and separated therefrom, a third sidewall 1130 extending between and connecting the first and second sidewalls 1110 and 1120 to one another, an end wall 1140 connecting the first, second and third sidewalls 1110-1130 to one another, and an open end 1150 (see FIG. 2) opposite to the first end wall 1140.

Referring to FIGS. 2 and 4, the first to third sidewalls 1110-1130 and the end wall 1140 define an interior of the head portion 1100 that is configured to receive the cushion 1300 therein.

As illustrated in FIGS. 2 and 4, the first sidewall 1110 may include a first elongated track protrusion 1112 extending in the first direction X in the interior of the head portion 1100, and the second sidewall 1120 may include a second elongated track protrusion 1122 extending in the first direction X in the interior of the head portion 1100 as well.

Referring to FIGS. 2 and 4-8, the cushion 1300 may include a first elongated groove 1324 extending in the first direction X and a second elongated groove 1334 also extending in the first direction X. The first and second grooves 1324 and 1334, respectively, are configured to receive the first and second protrusions 1112 and 1122 of the head portion 1100 therein order to selectively connect the head portion 1100 and the cushion 1300 with one another.

For example, as can be gleaned with reference to FIG. 4, the cushion 1300 can be coupled to the head portion 1100 by aligning the first and second grooves 1324 and 1334 with the first and second protrusions 1112 and 1122 of the head portion 1100, and sliding the cushion 1300 toward the first end wall 1140. The cushion 1300 can be slid in the opposite direction, e.g., away from the first end wall 1140, in order to selectively disconnect the cushion 1300 from the head portion 1100.

Referring to FIGS. 2 and 4, the end cap 1400 can be selectively connected to the head portion 1100 at the open end 1150 in order to secure the cushion 1300 to the head portion 1100. For example, the end cap 1400 may form an interference fit with the head portion 1100 in order to secure the cushion 1300 to the head portion 1100.

For this purpose, and with reference to FIGS. 2 and 4, the end cap 1400 may include an end wall 1410 configured to close the open end 1150 of the head portion 1100, and first, second and third sidewalls 1420, 1430 and 1440 configured to form an interference fit with protruding portions 1114, 1124 and 1132 of the head portion 1100. In other words, the interference fit between the end cap 1400 and the head portion 1100 may maintain the cushion 1300 securely connected to the head portion 1100.

The present invention is not limited to the selective connection between the cushion 1300 and the head portion 1100 described above. Other selective connecting mechanisms may be employed to selectively connect and disconnect the cushion 1300 and the head portion 1100 to/from one another. For example, the head portion 1100 may include only one elongated protrusion from among the first and second protrusions 1112 and 1122, and the cushion 1300 can be configured to include only one of the first and second matching grooves 1324 and 1334.

Other selective mechanisms can be used as well to selectively connect the cushion 1300 and the head portion 1100 to one another. These mechanisms may include, for example, snap-on fasteners, clip-on fasteners, hook and loop fasteners, screw(s) threadably engageable to both the cushion 1300 and the head portion 1100, magnet(s) and/or ferromagnetic material attached to the cushion 1300 and the head portion 1100, etc.

The end cap 1400 is described as being a component of the hairbrush 1000 that is configured to secure the cushion 1300 onto the head portion 1100. However, the present invention is not limited to this configuration. For example, the cushion 1300 can also be configured to form an interference fit with the brush head 1100 in order to prevent the cushion 1300 from accidentally becoming disengaged from the brush head 1100 during use (e.g., by sliding out of the open end 1150 of the brush head 1100).

The shape and size of the brush head portion 1100 and the cushion 1300 can be configured such that frictional forces generated between the head portion 1100 and the cushion 1300—as a result of the interference fit therebetween—are large enough to prevent the cushion 1300 from sliding away from the head portion 1100 during use of the hairbrush 1000, but low enough such that a user need apply only a reasonable amount of force to selectively slide the cushion 1300 in and out of the head portion 1000.

The other selective mechanisms described above (e.g., snap-on, hook and loop fasteners, etc.) can also be used to achieve a selective connection between the head portion 1100 and the cushion 1300 that is strong enough to maintain the head portion 1100 and the cushion 1300 coupled to one another during use of the hairbrush 1000 but weak enough to enable a user to utilize only a reasonable level of force to uncouple the cushion 1300 from the head portion 1100 when needed.

When the cushion 1300 is configured to form an interference fit with the brush head 1100, (or when other selective mechanisms described above are utilized to maintain the cushion 1300 selectively connected to the head portion 1100) the end cap 1400 can be omitted, or can be retained for aesthetic purposes (e.g., to cover the open end 1150 of the head portion 1100).

Figure 3:
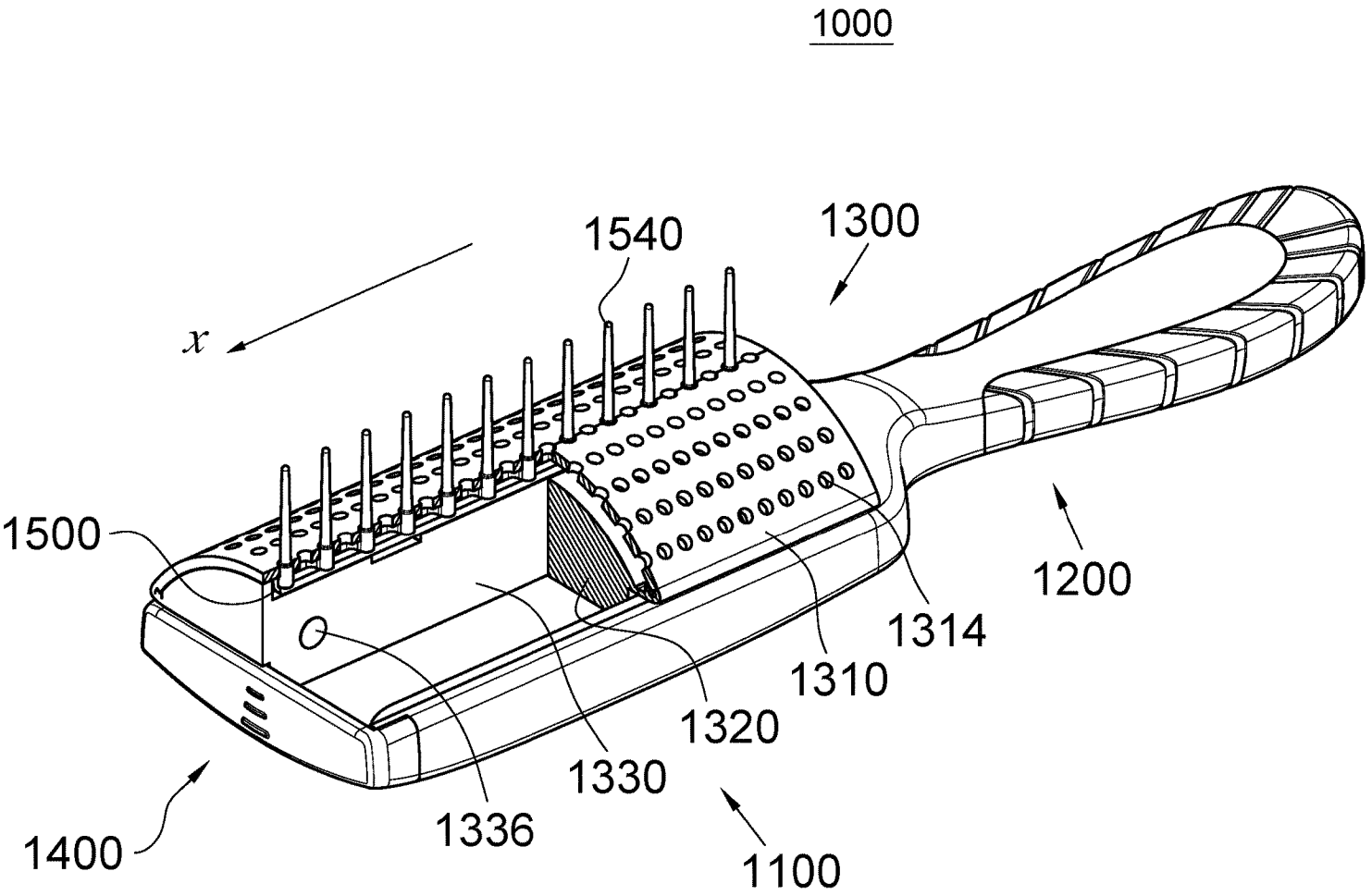
FIG. 3 is a partial cross-sectional view illustrating the hairbrush of FIG. 1.

Referring to FIGS. 1-4 the handle portion 1200 may extend from the head portion 1100, and may have a generally curved shape for a comfortable grip. As illustrated in FIG. 2, the handle portion 1200 may include a body 1210 and a cover 1220 covering at least a portion of the body 1210. As illustrated in FIGS. 1-3, the cover 1220 may include a plurality of grooves for increased grip.

The head portion 1100 and the handle portion 1200 may be made of a same material as one another, or of different materials. The head portion 1100 and the handle portion 1200 may be made of, for example, a metal (or an alloy of metals), wood, a polymeric material (e.g., plastic material), or a combination thereof.

The metal or alloy of metals used to form the head portion 1100 and/or the handle portion 1200 is preferably of a low molecular weight in order to maintain the weight of the hairbrush 1000 low. The metal may be, or the alloy may contain, for example, aluminum, titanium, magnesium, etc., since these are low density (e.g., lightweight) metals. However, denser metals such as, for example, iron, copper, etc., may also be utilized if desired.

Examples of polymeric materials suitable for forming the head portion 1100 and/or the handle portion 1200 include, but are not limited to, polycarbonate, polyvinyl chloride (PVC), acrylonitrile butadiene styrene (ABS), polyoxymethylene (POM), etc., or a combination thereof.

The cover 1220 of the handle portion 1200 may be made of a soft and/or grippy material, for example, rubber, silicone, etc.

While the hairbrush 1000 is described as featuring a handle portion 1200, the present invention is not limited to this configuration. For example, the handle portion 1200 can also be omitted. In this case, a user would grasp the head portion 1100 directly and utilize the hairbrush in that fashion.

Referring to FIGS. 3-8, the cushion 1300 may include an upper portion 1310 extending along the first direction X, a first lower portion 1320 hingedly connected to a first side of the upper portion 1310 via a first crease or fold 1340, and a second portion 1330 hingedly connected to a second side of the upper portion 1310, opposite to the side of the upper portion 1310 that the first lower portion 1320 is connected to, and hingedly connected to the upper portion 1310 via a second crease or fold 1350.

In other words, the cushion 1300 may be one integral structure with the pair of creases or folds 1340 and 1350 as the living hinges delimiting the borders between the upper portion 1310, the first lower portion 1320 and the second lower portion 1330. Alternatively, or in addition, one or more hinges may be used to connect the first and second lower portions 1320 and 1330 to the upper portion 1310 at the respective locations of the creases or folds 1340 and 1350.

As illustrated in FIGS. 2-8, the upper portion 1310 of the cushion 1300 may include a plurality of through openings 1314 arranged in a plurality of rows 1312. With reference to FIGS. 3-8, the openings 1314 in each row 1312 may be spaced apart from one another along a length of the row 1312. As illustrated in FIG. 2-8, the rows 1312 may be straight and parallel to axial direction X. In addition, as illustrated in FIGS. 2-8, the spacing between the openings 1314 in each row 1312 may be uniform.

The plurality of openings 1314 in the cushion 1300 are illustrated as being regularly arranged in FIGS. 2-8. In other words, the plurality of openings 1314 may be arranged in a plurality of rows 1312 and columns (extending perpendicular to the rows 1312). However, the present invention is not limited to this configuration. For example, the plurality of openings in a cushion of the present invention may also be arranged in a staggered formation (e.g., in rows that are staggered with one another) or at an acute angle from the axial direction X.

Referring to FIGS. 1-8, each of the openings 1314 in the cushion 1300 is configured to enable a bristle element 1540 of a bristle bar 1500 (see FIGS. 9-11) to extend from under the upper portion 1310 (from in between the upper portion 1310 and the first or second lower portions 1320 and 1330 of the cushion 1300), through the upper portion 1310, and in a direction away from the cushion 1300. The through openings 1314 may also be referred to as bristle openings.

As illustrated in FIGS. 1-8, the upper portion 1310 of the cushion 1300 may include, for example, nine rows 1312 of bristle openings 1314, and each row 1312 may include, for example, twenty-four openings 1314, but this configuration is non-limiting. The number of rows 1312 in the cushion 1300 can be varied as needed, and can be, for example, one or greater than one. In addition, the number of openings 1314 in each row 1312 can be varied as needed, and can be, for example, one or greater than one.

Referring to FIGS. 2-7, the cushion 1310 appears from outside of the hairbrush 1000 to extend convexly about the first direction X. In other words, the cushion 1300 may be curved. However, the cushion 1300 may assume a flat or substantially flat shape when removed from the head portion 1100 and opened as illustrated in FIG. 8.

The cushion 1300 may be made of a flexible material such that the upper portion 1310 may be deformable between the curved and flat states described above. For example, the cushion 1300 may be made of a metal and/or a polymeric material (including, for example, rubber, silicone, etc., and/or low density polymers such as, for example sponge, foam, etc.).

When made out of sponge and/or foam, the cushion 1300 may be bendable and squeezable. In this case, pressure applied to the bristle elements 1540 may cause the cushion 1300 to be bent inwardly for comfort purposes.

When the upper portion 1310 of the cushion 1300 is made of a metal or a polymeric material, and the thickness of the upper portion 1310 needs to be thin enough to allow the cushion 1300 to flex between the curved and flat states described above, and to do so with only a reasonable amount of force.

Alternatively, the upper portion 1310 may be stamped to have a curved shape as illustrated in FIGS. 1-7. In this case, the upper portion 1310 might or might not become flat when the cushion 1300 is removed from the head portion 1100 and opened as illustrated in FIG. 8, depending on the flexibility of the stamped material.

The cushion 1300 can also be made of wood. In this case, the upper portion 1300 may be substantially rigid (since wood is generally a rigid material) and may have a predefined curvature. In this case, hinges may be utilized to hingedly connect the first and second lower portions 1320 and 1330 to the upper portion 1310.

Regardless of the material of the upper portion 1310, the first and second lower portion 1320 and 1330 of the cushion 1300 may be made of a bendable and squeezable material, for example, foam and/or sponge, such that the bristle elements 1540 can be pushed inwardly into the cushion 1300 during use of the hairbrush 1000 for comfort purposes. Alternatively, the first and lower portion 1320 and 1330 may be made of a stiffer or rigid material to support the bristle bars 1500.

Figure 6:
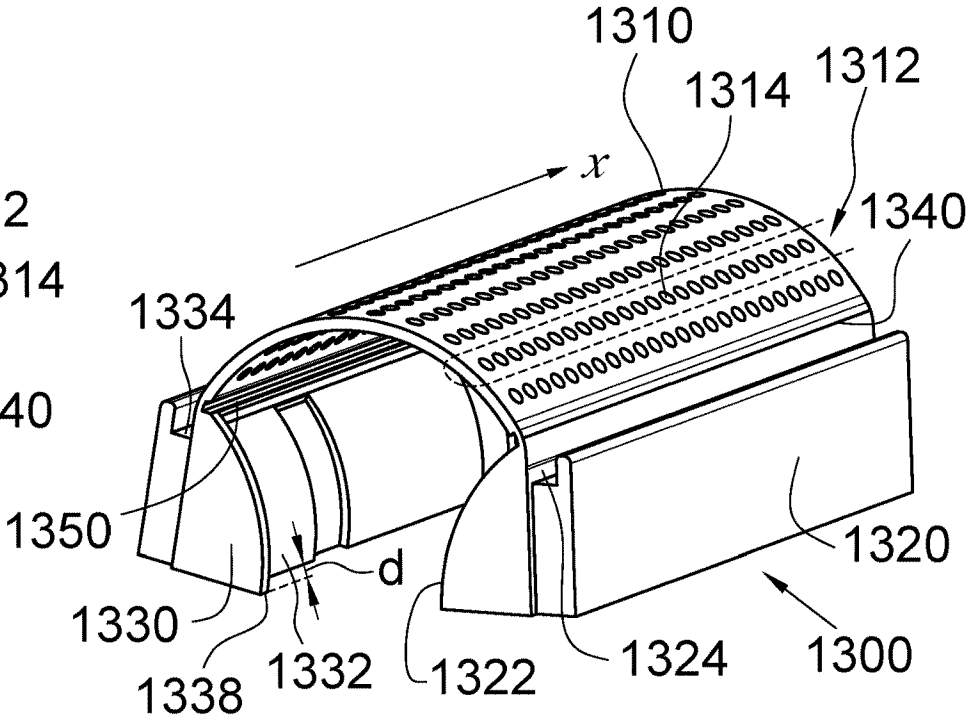
FIG. 6 is a perspective view illustrating the cushion of FIG. 5 in a partially opened state.
Figure 5:
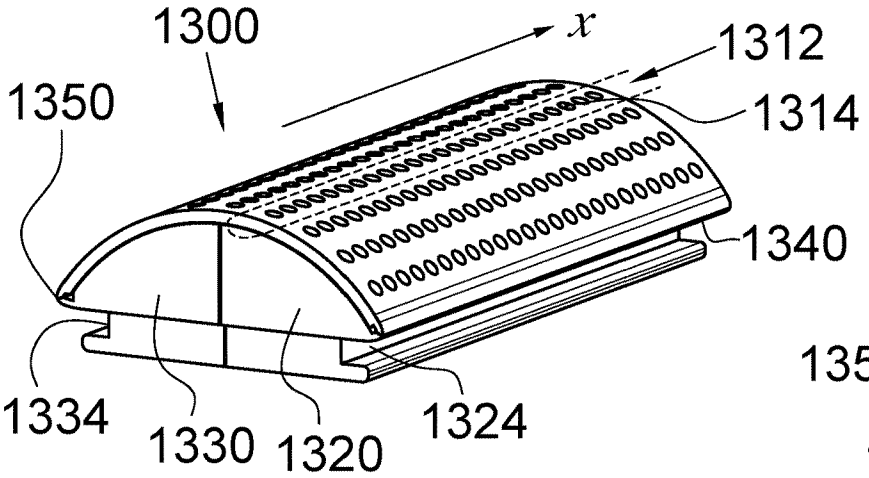
FIG. 5 is a perspective view illustrating a cushion included in the hairbrush of FIG. 1 in a closed state according to an exemplary embodiment of the present invention.
Figure 7:
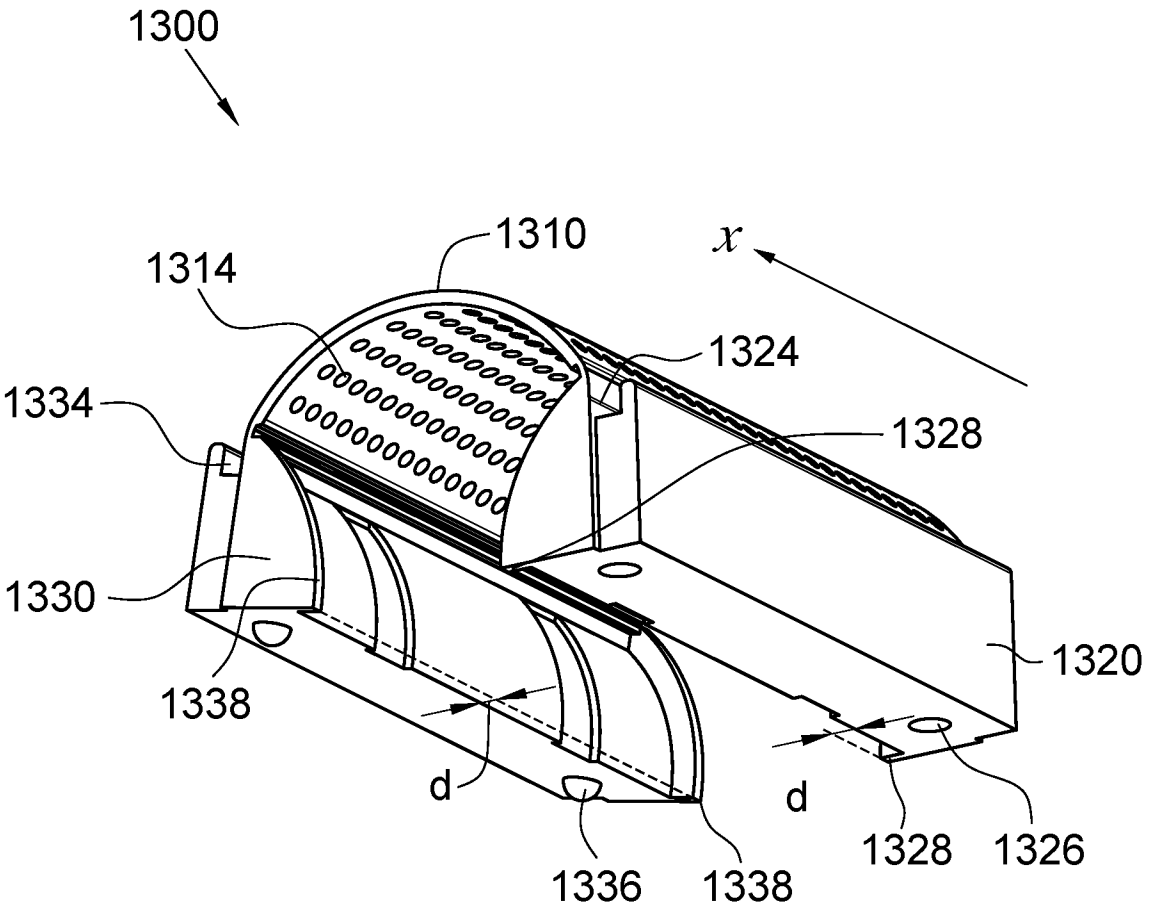
FIG. 7 is a perspective view illustrating the cushion of FIG. 5 in a partially opened state.
Figure 8:
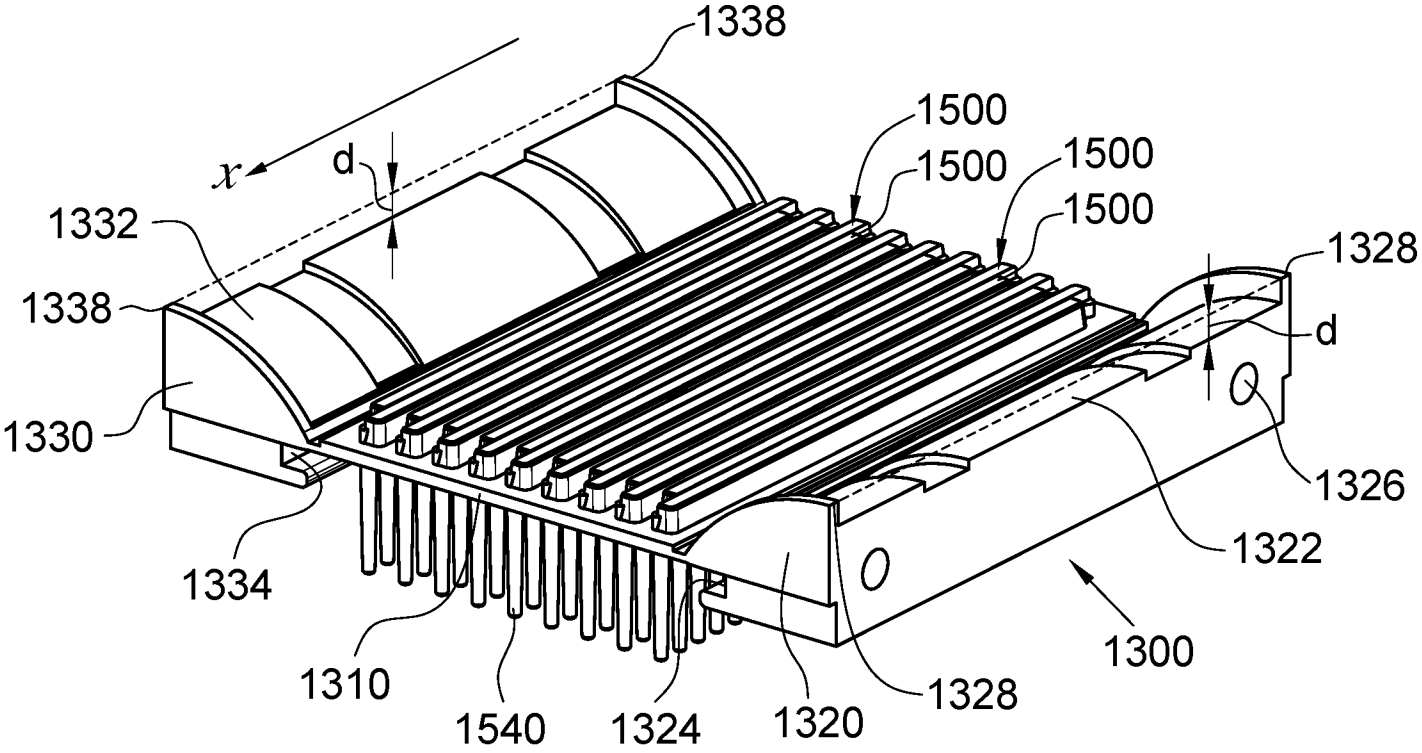
FIG. 8 is a perspective view illustrating the cushion of FIG. 5 in an opened state and loaded with a plurality of bristle bars.

Referring to FIGS. 6-8, the first lower portion 1320 may include a surface 1322 extending convexly in the first direction X and configured to face the upper portion 1310 when the cushion 1300 is in a closed state, as illustrated in FIG. 5. Referring to FIGS. 6-8 again, the second lower portion 1330 may include a surface 1332 extending convexly in the first direction X and configured to face the upper portion 1310 when the cushion 1300 is in a closed state as illustrated in FIG. 5. The convex surfaces 1322 and 1332 may define the curvature (or degree of convexity) of the upper portion 1310 of the cushion 1300 when the upper portion 1310 is flexible and the cushion 1300 is in a closed state as illustrated in FIG. 1.

Alternatively, when the upper portion 1310 is stamped to retain a predefined curvature, the curvature of the convex surfaces 1322 and 1332 may match the curvature of the upper portion 1310.

Referring to FIG. 7-8, the first lower portion 1320 may have a pair of flanges 1328 at opposite ends thereof, and a separating distance "d" may be formed between the flanges 1328 and the convex surface 1322 of the first lower portion 1320. The distance "d" forms a gap between the convex surface 1322 and a bottom surface of the upper portion 1310 when the cushion 1300 is in a closed state as illustrated in FIG. 5. The gap is configured to accommodate the base 1510 of one or more bristle bars 1500 therein when the bristle bars 1500 are loaded into the cushion 1300, as illustrated, for example, in FIG. 1.

Referring to FIGS. 6-8, the second lower portion 1330 may have a pair of flanges 1338 at opposite ends thereof, and a separating distance "d" may be formed between the flanges 1338 and the convex surface 1332 of the second lower portion 1330. The distance "d" forms a gap between the convex surface 1332 and the bottom surface of the upper portion 1310 when the cushion 1300 is in a closed state as illustrated in FIG. 5. The gap is configured to accommodate the base 1510 of one or more bristle bars 1500 therein when the bristle bars 1500 are loaded into the cushion 1300, as illustrated, for example, in FIG. 1.

This configuration of the cushion 1300 is advantageous because the flanges 1328 and 1338 create a space for accommodating the bases 1510 of the bristle bars 1500 within the cushion 1300 while simultaneously concealing the gap from the outside for a pleasing aesthetic appearance.

As illustrated in FIGS. 3 and 7, but more particularly in FIG. 7, the first lower portion 1320 may include a plurality of concave regions 1326, and the second lower portion 1330 may include a plurality of protrusions (or convex regions) 1336. The concave regions 1326, respectively, are sized, shaped and positioned in the first lower portion 1320 to accommodate the convex regions 1336 therein when the first and second lower portions 1320 and 1330 and positioned in a closed state as illustrated in FIG. 1-5.

The concave and convex regions 1326 and 1336 can be utilized to aid a user in aligning the first and second lower portions 1320 and 1330 with one another in the process of closing the cushion 1300 as illustrated in FIGS. 6 and then 5, after having loaded the cushion 1300 with bristles bars 1500, for example, as illustrated in FIG. 8. In addition, the concave and convex regions 1326 and 1336 may assist in maintaining the first and second lower portions 1320 and 1330 aligned with one another in a rectangular configuration, as illustrated in FIGS. 1-4, when the cushion 1300 is inserted into the head portion 1100.

The number, positioning and shape of the concave and convex regions 1326 and 1336 can be modified as needed to serve the purpose(s) stated above.

Other mechanisms may be used in addition to, together with, or in lieu of the concave and convex regions 1326 and 1336 for aligning and/or maintaining the cushion 1300 in an aligned state within the head portion 1100. Such mechanisms may include, for example, hook and loop fasteners, magnets, etc.

However, the concave and convex regions 1326 and 1336 may also be omitted.

FIGS. 1, 2 and 8 illustrate the hairbrush 1000 loaded with a plurality of bristle bars 1500. FIG. 3 illustrates the hairbrush 1000 loaded with only one bristle bar 1500 for clarity purposes.

Figure 9:
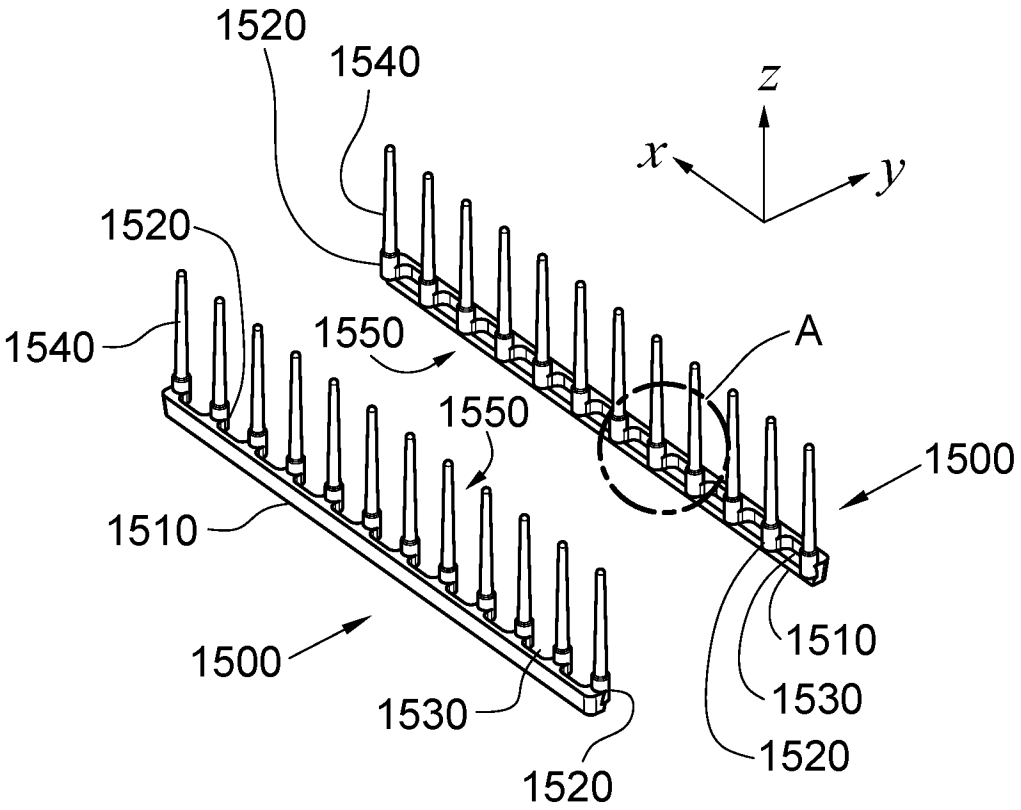
FIG. 9 is a perspective view illustrating a pair of bristle bars of the cushion included in the hairbrush of FIG. 1 but in a separated state prior to being loaded into the cushion.
Figure 11:
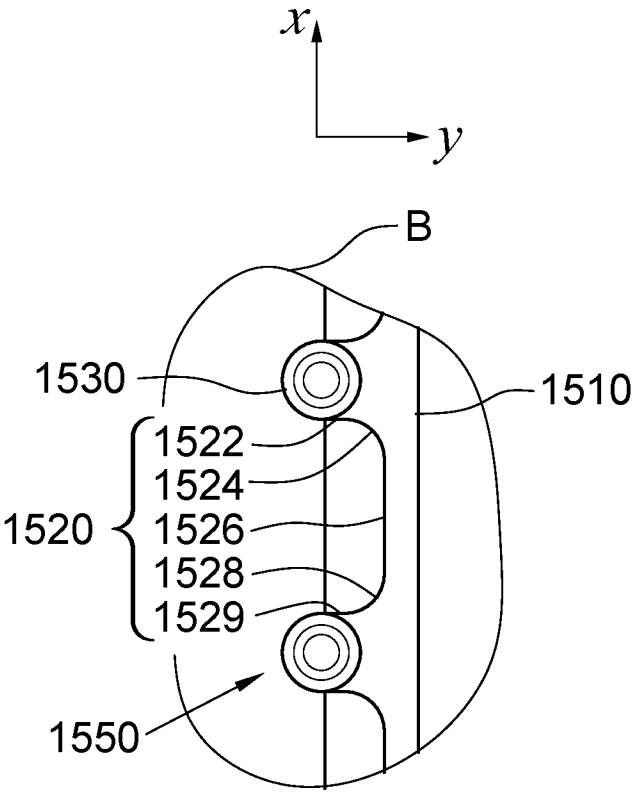
FIG. 11 is a top plan view illustrating a magnified region B of FIG. 10.
Figure 10:
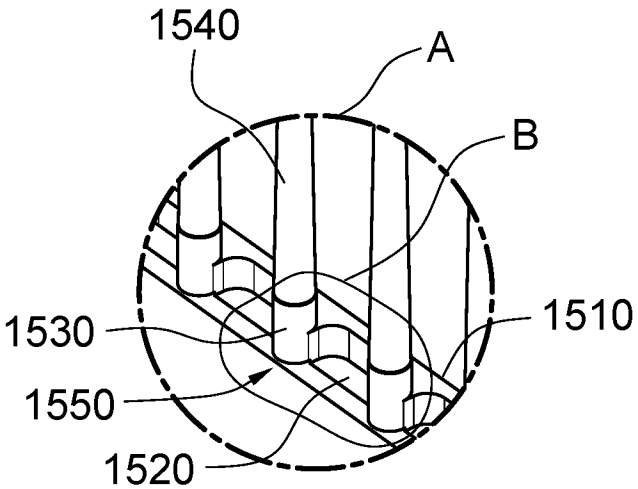
FIG. 10 is a perspective view illustrating a magnified region A of FIG. 9.
Figure 12:
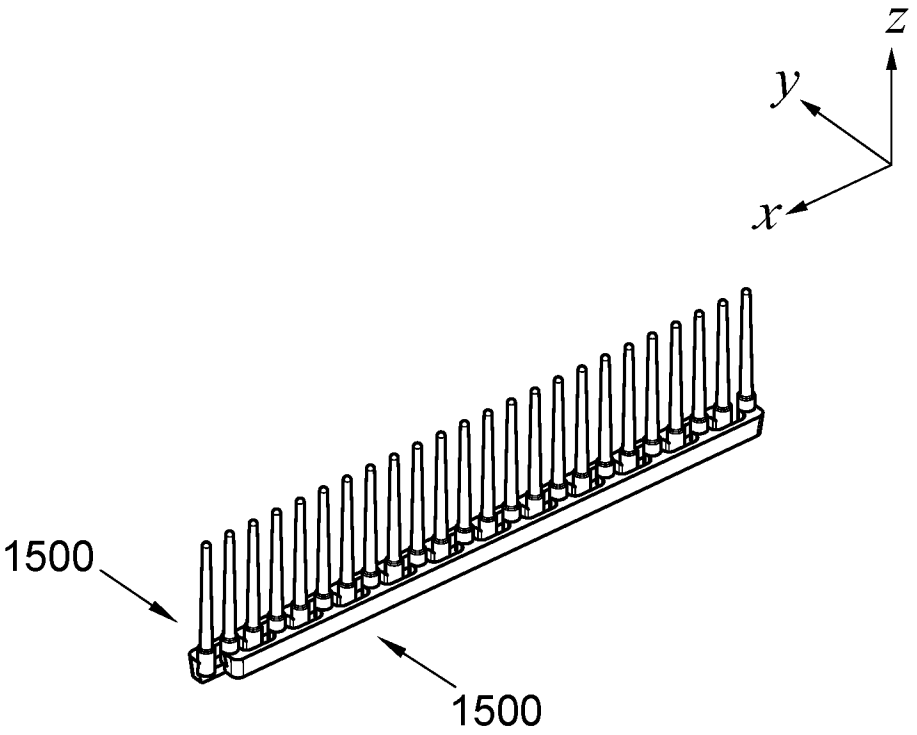
FIG. 12 is a perspective view illustrating the pair of bristle bars of FIG. 9 in an interlocked arrangement with one another.

As can be gleaned with reference to FIG. 8, each row 1312 of openings 1314 in the cushion 1300 may be loaded with a pair of bristle bars 1500. A representative pair of bristle bars 1500, loaded into each row 1312 of openings 1314 in the cushion 1300 of FIGS. 1, 2 and 8, is illustrated separately in FIGS. 9 and 12 for clarity purposes. In FIG. 9 the bristle bars 1500 are illustrated as being separated from one another for clarity purposes. In FIG. 12 the bristle bars 1500 are illustrated as being interlocked with one another, as they would be when inserted into a row 1312 of openings 1314. FIGS. 10-11 illustrate magnified views of one of the bristle bars 1500 of FIGS. 9 and 12.

Referring to FIGS. 9-12, each of the bristle bars 1500 may include an elongated base 1510 extending in the first direction X, having a width in a second direction Y, and a height in a third direction Z (see FIG. 9), and a plurality of bristle elements 1540 extending from the base 1510. Referring to FIGS. 9-12, in each of the bristle bars 1500, the bristle elements 1540 may be arranged in a row in the first direction X, may be separated from one another, and may extend in the third direction Z.

As illustrated in FIG. 9, the first and second directions X and Y may cross one another. For example, the first and second directions X and Y may extend perpendicularly to one another. Referring to FIG. 9, the third direction Z may cross each of the first and second directions X and Y. For example, the third direction Z may extend perpendicularly to each of the first and second directions X and Y.

Each bristle element 1540 on each bristle bar 1500 may include one individual bristle, or a tuft of bristles (e.g., a plurality of bristles bundled together).

The individual bristle(s) forming each bristle element 1540 may be made of a natural material, of a synthetic material, or a combination thereof. For example, when a bristle element 1540 includes a tuft of bristles, the tuft may be made up of only natural bristles, of only synthetic bristles, or of a combination of natural and synthetic bristles.

A bristle made of natural material may be partially flexible and partially stiff, with the flexibility/stiffness thereof selected based on a particular application of the hairbrush.

A bristle made of natural material may be, for example, animal hair, a feather or plant material (e.g., plant fiber). A bristle made of animal hair may be, for example, equine hair (e.g., horse or zebra hair), bovine hair, goat hair, donkey/mule hair, camel hair, llama hair, boar/swine hair, badger hair, mink hair, sable hair, etc. The present invention is not limited to the above-recited examples of natural bristles.

A bristle made of synthetic material may contain, for example, nylon, polyester, polyurethane, PVC, polycarbonate, etc., or a blend thereof. The present invention is not limited to the above-recited examples of natural bristles.

While it is illustrate in FIGS. 1-3 and 8-12 that all of the bristle elements 1540 in a bristle bar 1500 are the same as one another, this is non-limiting. For example, a bristle bar 1500 can also include different bristle elements 1540 along its length. In more detail, first bristle element 1540 in a bristle bar 1500 may include a bristle that is longer or shorter, thicker or thinner, stiffer or more flexible, having a different cross-section or a different shape or profile shape, etc., than a bristle included in a second bristle element 1540 of the same bristle bar 1500.

Referring to FIGS. 9-11, and more particularly to FIGS. 10-11, a first side 1550 of the base 1510 of each bristle bar 1500 includes a plurality of alternating protrusions 1530 and indentations 1520 along a length of the base 1510 (e.g., along the first direction X). Referring to FIGS. 10-11, the protrusions 1530 may extend outwardly from the base 1510 with respect to an imaginary line K (see FIG. 11) in a direction opposite second direction Y, and the indentations 1520 may extend into the base 1510 with respect to the imaginary line K (see FIG. 11) in the second direction Y, opposite to the protrusions 1530.

As illustrated on FIGS. 3 and 8-12, in each bristle bar 1500, each bristle element 1540 may extend from a protrusion 1530 of the base 1510. While it is exemplarily illustrated in the figures that each protrusion 1530 is populated with a bristle element 1540, the present invention is not limited thereto. For example, one or more protrusion(s) 1530 in a bristle bar 1500 may be left unpopulated by a bristle element 1540.

As illustrated in FIG. 11, the protrusions 1530 may be curved, and each indentation 1520 may include a first straight portion 1522, a first concave portion 1524 extending from the straight portion 1522, a second straight portion 1526 extending from the concave portion 1524, a second concave portion 1528 extending from the straight portion 1526, and a third straight portion 1529 extending from the concave portion 1528.

Importantly, each indentation 1520 is shaped and sized to receive a protrusion 1530 therein. Since the protrusions 1530 and indentations 1520 in a bristle bar 1500 are alternatively arranged with one another along the length of the bristle bar 1500, this configuration enables two separate bristle bars 1500, as illustrated in FIG. 9, to be interlocked with one another, as illustrated in FIG. 12.

This configuration of the base 1510 of the bristle bars 1500 is advantageous for a multitude of reasons. First, the bases 1510 of all of the bristle bars 1500 utilized in the hairbrush 1000 may have the same configuration as one another (since they can be interlocked with one another). Thus, only one manufacturing template is needed to manufacture the bases 1510 of all the bristle bars 1500, be it one molding configuration when a base 1510 is made by injecting a polymer into a mold, one set of computer instructions to guide a computer numerical control (CNC) tooling machine (e.g., a CNC mill or lathe) to carve/grind a bar of metal, wood or polymer material into the shape of the base 1510, one set of computer instructions to guide a three-dimensional (3D) printer to form the base 1510, etc.

By avoiding the development of a plurality of different injection molds, a plurality of CNC machining instructions, or a plurality of 3D printing files, the process of manufacturing the bases 1510 of the bristle bars 1500 of the present invention has a low cost. This may also increase manufacturing throughput.

Second, the configuration of the bristle bars 1500 with the bristle elements 1540 in each bristle bar 1500 being spaced apart from one another by the indentations 1520 enables one bristle bar 1500 to fill with bristles an entire length of a given row 1312 of openings 1314 (see FIG. 3). Due to the configuration of the alternating protrusions 1530 and indentations 1520, the bristle elements 1540 of each bristle bar 1500 may occupy every other opening 1314 in a given row 1312 (See FIG. 3).

When adding (e.g., coupling) a second bristle bar 1500 to row 1312 of openings 1314 that already contains a first bristle bar 1500, each of the two bristle bars 1500 occupies the entire length of the same row 1312 of openings 1314.

This affects the density of the bristle elements 1540 along a row 1312 of openings 1314. Density in this case means the number of bristle elements 1540 per unit length along a row 1312 of openings 1314. For example, when coupling one bristle bar 1500 to a first row 1312 of openings 1314, a certain number of bristle elements 1540 may protrude upwardly from the cushion 1300 along the first row 1312 (see FIG. 3, illustrating 12 bristle elements 1540 protruding upwardly from the uppermost row 1312 of openings 1314).

In addition, the configuration of the protrusions 1530 and indentations 1520 enables the bristle elements 1540 of two interlocked bristle bars 1500 to be arranged linearly with one another, as illustrated in FIGS. 1-2, 8 and 12. This is so because an indentation 1520 of a first bristle bar 1500 enables a protrusion 1530 of a second bristle bar 1500 (which may contain a bristle element 1540 extending from it) to be disposed adjacent to a pair of protrusion 1530 of the first bristle bar 1500. Thus, the bristle elements 1540 of one of the bristle bars 1500 would be arranged in line with the bristle elements 1540 of the other bristle bar 1500.

Turning to FIGS. 1-12 and 8-12, when coupling a second bristle bar 1500 to a row 1312 of openings 1314 that already contains a first bristle bar 1500, the row 1312 now may have double the number of bristle elements 1540 extending therefrom (see FIG. 1 illustrating 24 bristle elements 1540 extending upwardly from the middle row 1312 of openings 1314).

In addition, when a first bristle bar 1500 is arranged in an interlocking manner with a second bristle bar in the same row 1312 of openings 1314, as can be gleaned with reference to FIGS. 1 and 9-12, the bristle elements 1540 of the first bristle bar 1500 are alternatively arranged with the bristle elements 1540 of the second bristle bar 1500 along the length of the row 1312 of openings 1314 (since the bristle elements 1540 of each bristle bar 1500 occupy every other opening 1314 in a row 1312). This enables the bristle elements 1540 of the first bristle bar 1500 to be distributed evenly with the bristle elements 1540 of the second bristle bar 1500 along the length of the same row 1312.

The even distribution is beneficial because it enables a user to modify the physical attributes of a row of bristle elements 1540 as a whole by selecting how many bristle bars 1500 to include in one row 1312 of openings 1314, and what characteristics should the bristle elements 1540 of the selected bristle bar(s) 1500 have. For example, a user may select to insert into a given row 1312 of openings 1314 a first bristle bar 1500 having stiff bristle elements 1540, and a second bristle bar 1500 having flexible bristle elements 1540. Since the stiff and flexible bristle elements 1540 are evenly distributed along the same row 1312, the row 1312 as a whole may perform as having been loaded with medium stiffness bristles (e.g., of bristles having a flexibility that is softer than that of the stiff bristles of the first bristle bar 1500, but stiffer than that of the flexible bristles of the second bristle bar 1500).

The utilization of bristle elements 1540 of different stiffness in the same row 1312 of openings 1314 is utilized merely as an example. A pair of bristle bars 1500 loaded in the same row 1312 of openings 1314 may also have bristle elements 1540 of, for example, different materials, different lengths, different stiffness, different cross-sections, different thicknesses, different shape, etc., or a combination thereof, in order to customize the characteristics of the bristles in each row 1312 of openings 1314 of the cushion 1300. This level of customization enables the hairbrush 1000 to be used on virtually any user with any hair type or styles.

As can be appreciated, the highly customizable configuration of a hairbrush 1000 of the present invention is beneficial not only for a non-professional user seeking to customize a hairbrush for his/her type of hair or style, but also advantageous to a hair stylist. This is so because the customization of the number, material, length, thickness, stiffness, cross-section, etc., of the bristle elements 1540 within each row 1312 of openings 1314 of the hairbrush 1000 would enable the stylist to configure the hairbrush 1000 as needed for each client, depending on the type of the client's hair, because hair of different lengths, thicknesses, textures, and degrees of curliness, etc., may require different bristle configurations within the same row of openings 1312.

Figure 15:
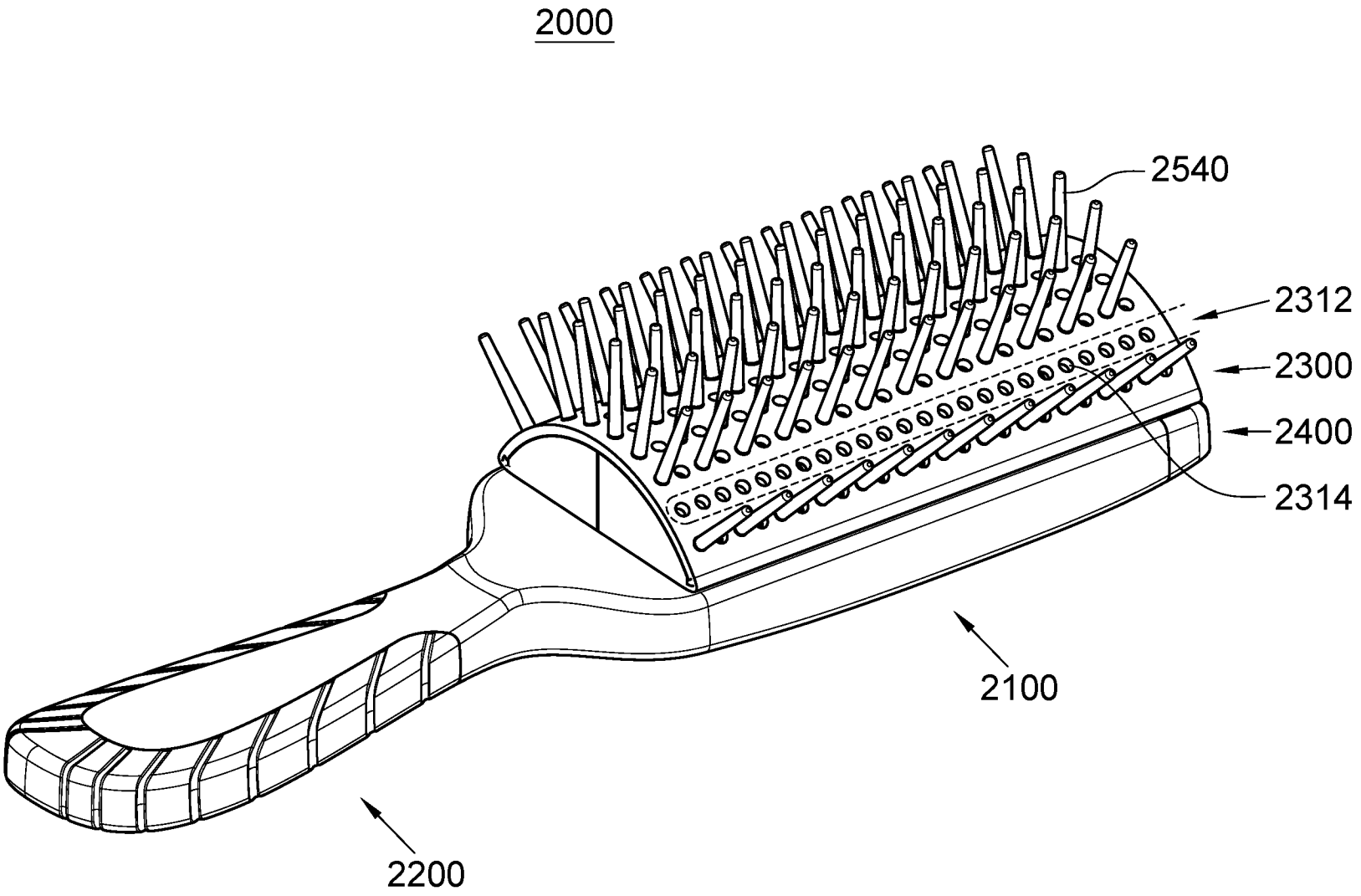
FIG. 15 is a perspective view illustrating a hairbrush according to an exemplary embodiment of the present invention.
Figure 16:
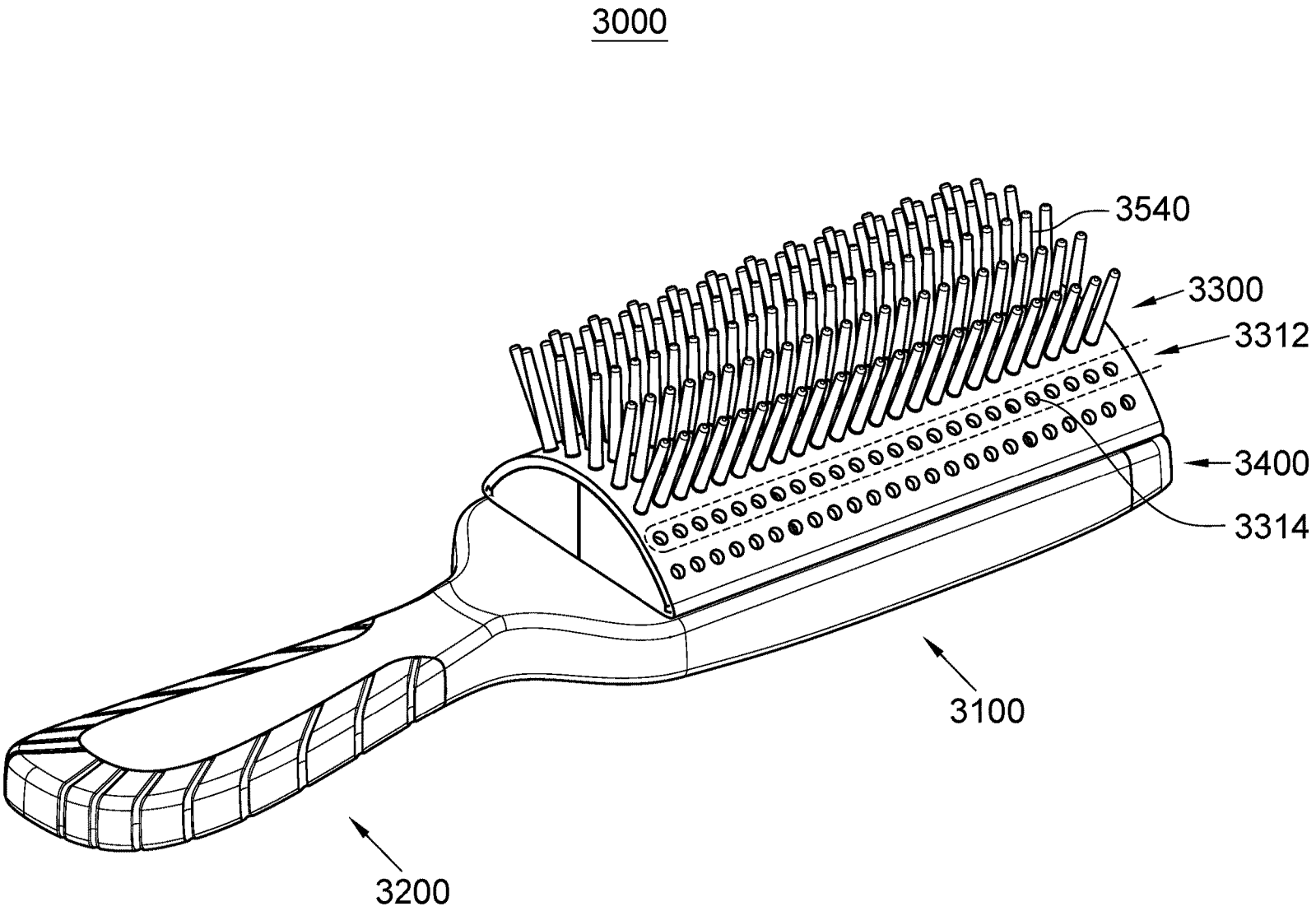
FIG. 16 is a perspective view illustrating a hairbrush according to an exemplary embodiment of the present invention.

In addition, a user need not load each and every row of openings 1312 in the cushion 1300 with bristle bar(s) 1500. A user can also customize the hairbrush 1000 by strategically leaving one or more of the rows of openings 1312 empty. FIGS. 15 and 16 illustrate such examples.

Referring to FIG. 15, a hairbrush 2000 may include a head portion 2100, a handle portion 2200 extending from the head portion 2100, a cushion 2300 selectively connected to the head portion 2100, and an end cap 2400 selectively connected to the head portion 2100. As illustrated in FIG. 15, a row 2312 of openings 2314 is left unoccupied in the cushion 2300. Other rows 2312 may be occupied by bristle bars having bristle elements 2540. Components of the hairbrush 2000 not described in detail may be assumed to be the same as or similar to corresponding components described in this specification.

Referring to FIG. 16, a hairbrush 3000 may include a head portion 3100, a handle portion 3200 extending from the head portion 3100, a cushion 3300 selectively connected to the head portion 3100, and an end cap 3400 selectively connected to the head portion 3100. As illustrated in FIG. 15, a plurality of rows 3312 of openings 3314 may be left unoccupied in the cushion 3300. Other rows 3312 may be occupied by bristle bars having bristle elements 3540. Components of the hairbrush 3000 not described in detail may be assumed to be the same as or similar to corresponding components described in this specification.

While the bristle elements 1540 in FIGS. 1, 2 and 8 are illustrated as being the same as one another, the present invention is not limited to this configuration. The bristle elements 1540 of a bristle bar(s) 1500 loaded in one of the rows 1312 of openings 1314 in the cushion 1300 may be the same as or different from the bristle elements 1540 of a second bristle bar 1500 loaded in that same row 1312 of openings 1314, or the same as or different from the bristle elements 1540 of bristle bar(s) 1500 loaded in other row(s) 1312 of openings 1314 in the cushion 1300.

Figure 17:
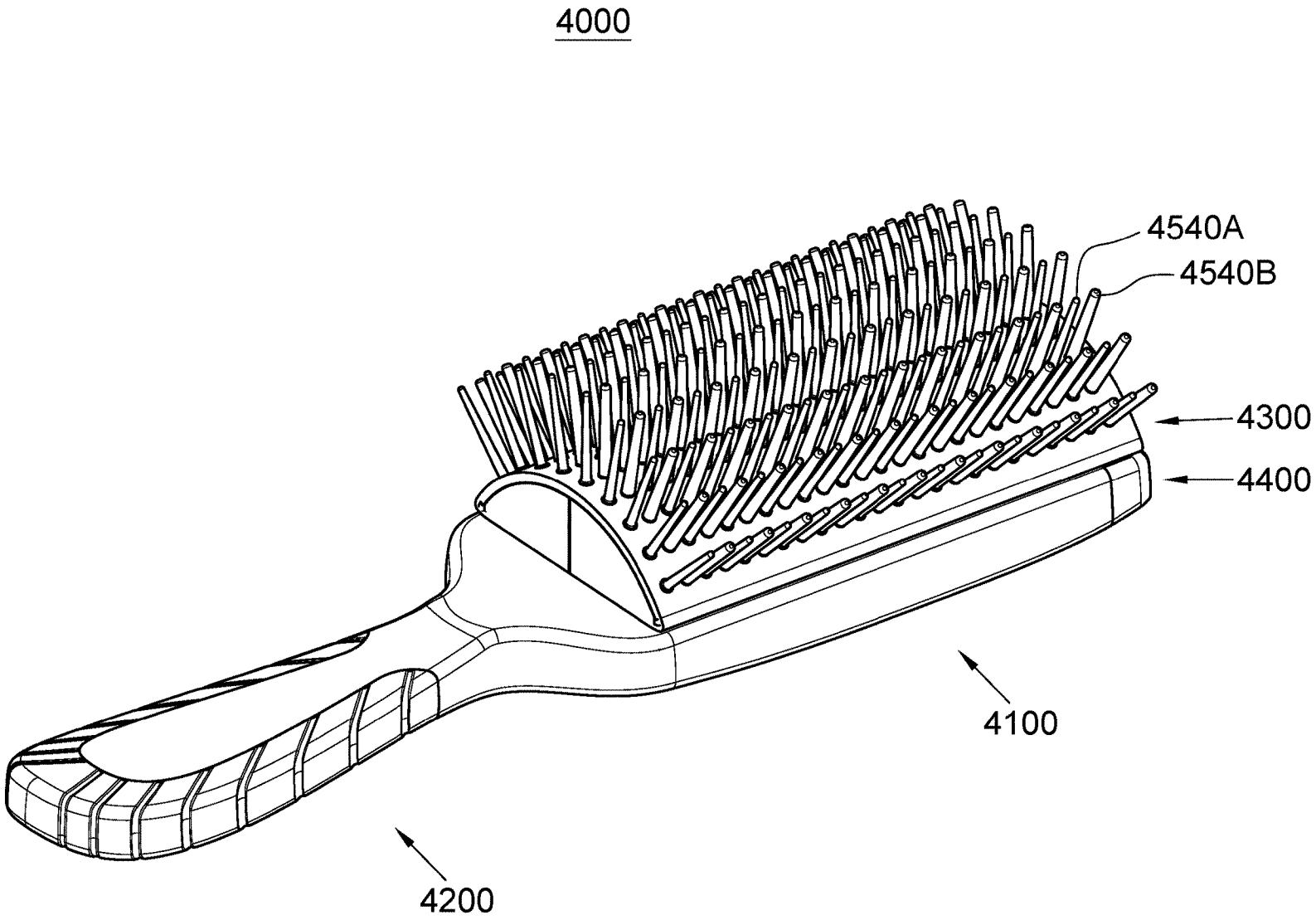
FIG. 17 is a perspective view illustrating a hairbrush according to an exemplary embodiment of the present invention.
Figure 18:
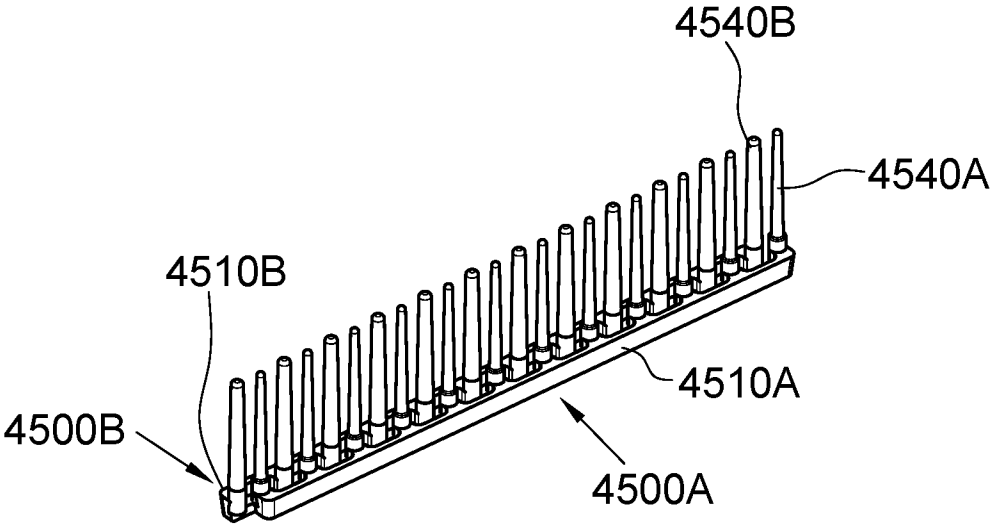
FIG. 18 is a perspective view illustrating a pair of bristle bars loaded in a cushion of the hairbrush of FIG. 17.

FIG. 17 illustrates an example of a hairbrush loaded with different bristle elements. FIG. 18 illustrates a pair of bristle bars loaded into a row of openings of a cushion of the hairbrush of FIG. 17.

Referring to FIGS. 17 and 18, a hairbrush 4000 may include a head portion 4100, a handle portion 4200 extending from the head portion 4100, a cushion 4300 selectively connected to the head portion 4100, and an end cap 4400 selectively connected to the head portion 4100.

A pair of bristle bars 4500A and 4500B, illustrated in FIG. 18, is loaded into each of the rows of openings of the cushion 4300 (see FIG. 17). Referring to FIGS. 17 and 18, the difference between the bristle bars 4500A and 4500B is that bristle elements 4540A of the bristle bar 4500A are thinner than bristle bars 4540B of the bristle bar 4500B. Otherwise, elongated base 4510A of the bristle bar 4500A and elongated base 4510B of the bristle bar 4500B may be identical to one another, and may feature protrusions and indentations as describe elsewhere in this specification. Components of the hairbrush 4000 not described in detail may be assumed to be the same as or similar to corresponding components described in this specification.

While it is exemplarity illustrated in the figures that adjacent rows of openings in a cushion may be loaded with the same combination of bristle bars, the present invention is not limited thereto. For example, a pair of bristle bars loaded into one row of openings of a cushion can be the same as or different from another pair of bristle bars loaded into a different row of bristle openings of the cushion.

In addition, the present invention is not limited to the configuration of the protrusions and indentations 1530 and 1520 of a bristle bar 1500 described above. The present invention encompasses bristle bars 1500 having different interlocking mechanisms as well.

Figure 13:
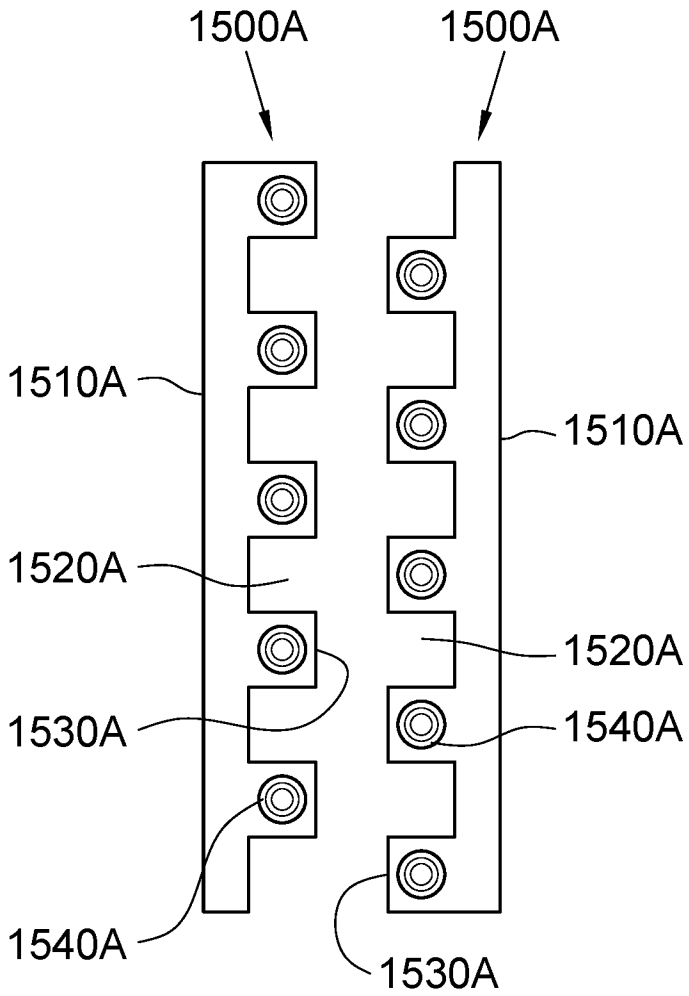
FIG. 13 is a top plan view illustrating a pair of bristle bars according to an exemplary embodiment of the present invention.

As an example, FIG. 13 illustrates a different kind of an interlocking mechanism of a pair of bristle bars 1500A. Referring to FIG. 13, in a pair of identical bristle bars 1500A, bristle bar 1500A includes a base 1510A with rectangular protrusion 1530A and rectangular indentations 1520A. A bristle element 1540A may extend from each protrusion 1530A.

Since the bristle elements 1540A extend from the protrusions 1530A of the bristle bars 1500A, and since the protrusions 1530A of one bristle bar 1500A are respectively configured to be received within the indentations 1520A of an adjacent bristle bar 1500A, this configuration enables the bristle elements 1540A of the two interlocked bristle bars 1500A to be aligned in a row with one another. This configuration is advantageous because it enables two bristle bars disposed side-by-side to have their respective bristles arranged in a straight line, as illustrated in FIGS. 1, 2 and 12.

Figure 14:
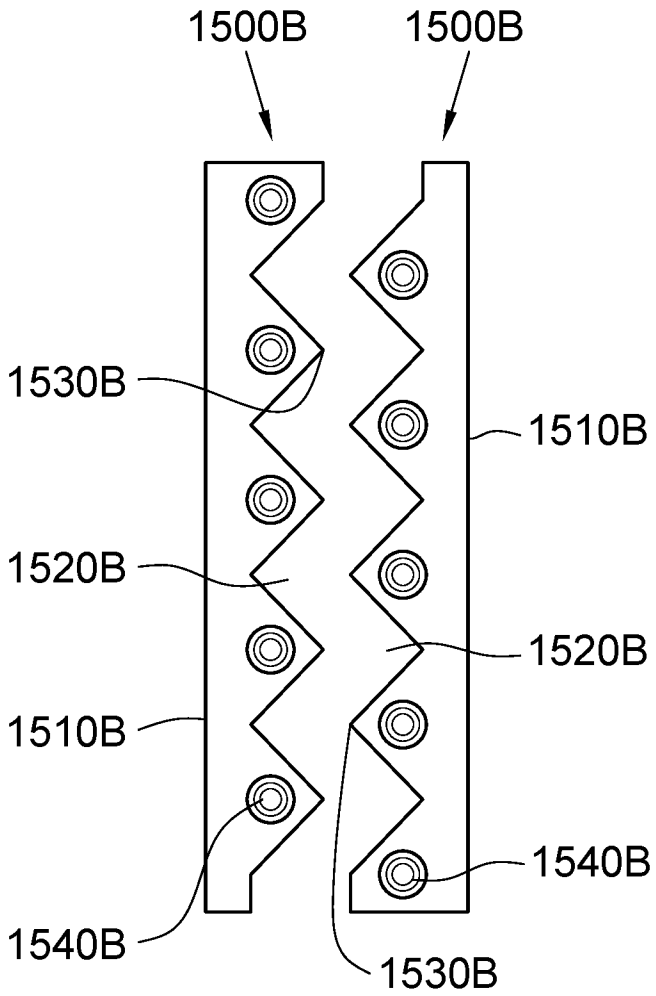
FIG. 14 is a top plan view illustrating a pair of bristle bars according to an exemplary embodiment of the present invention.

FIG. 14 illustrates an additional example of an interlocking mechanism of a pair of bristle bars 1500B. Referring to FIG. 14 a pair of identical bristle bars 1500B each include a base 1510B with triangular protrusion 1530B and triangular indentations 1520B. A bristle element 1540B may extend from each protrusion 1530B. When the bristle bars 1500B are interlocked with one another, their respective bristle elements 1540B would be aligned in a row with one another.

The protrusions 1530 and indentations 1520 of the bristle bars 1500, the protrusions 1530A and indentations 1520A of the bristle bars 1500A, and the protrusions 1530B and indentations 1520B of the bristle bar 1500B are described above as being interlockable with one another. Interlockable, in this case, means that the indentations 1520, 1520A and 1520B of a bristle bar, respectively, are shaped, sized and spaced in order to accommodate protrusions 1530, 1530A and 1530B of an adjacent bristle bar therein, but not necessarily that the protrusions 1530, 1530A and 1530B form an interference fit (e.g., a friction fit) with the indentations 1520, 1520A and 1520B.

However, depending on the configuration of the protrusions and indentations of a pair of mating bristle bars, the protrusions and indentations of one bristle bar can also be configured to form an interference with the protrusions and indentations of another bristle bar. This may enable a user to friction fit a pair of bristle bars to one another, and then load the pair of bristle bars as one unit into the cushion 1300.

For example the protrusions 1530 and indentations 1520 of one of the bristle bars 1500 illustrated in FIGS. 10 and 11 can be sized, shaped and spaced to form an interference fit with the protrusions 1530 and indentations 1520 of the other bristle bar 1500 illustrated in FIGS. 10 and 11. In addition, the protrusions 1530A and indentations 1520A of one of the bristle bars 1500A illustrated in FIG. 13 can be sized, shaped and spaced to form an interference fit with the protrusions 1530A and indentations 1520A of the other bristle bar 1500A illustrated in FIG. 13.

Alternatively, when the bristle bars are not configured to form a friction fit with one another, the bristle bars may be loaded and unloaded one-at-a-time from the rows of openings of a cushion.

Figure 19:
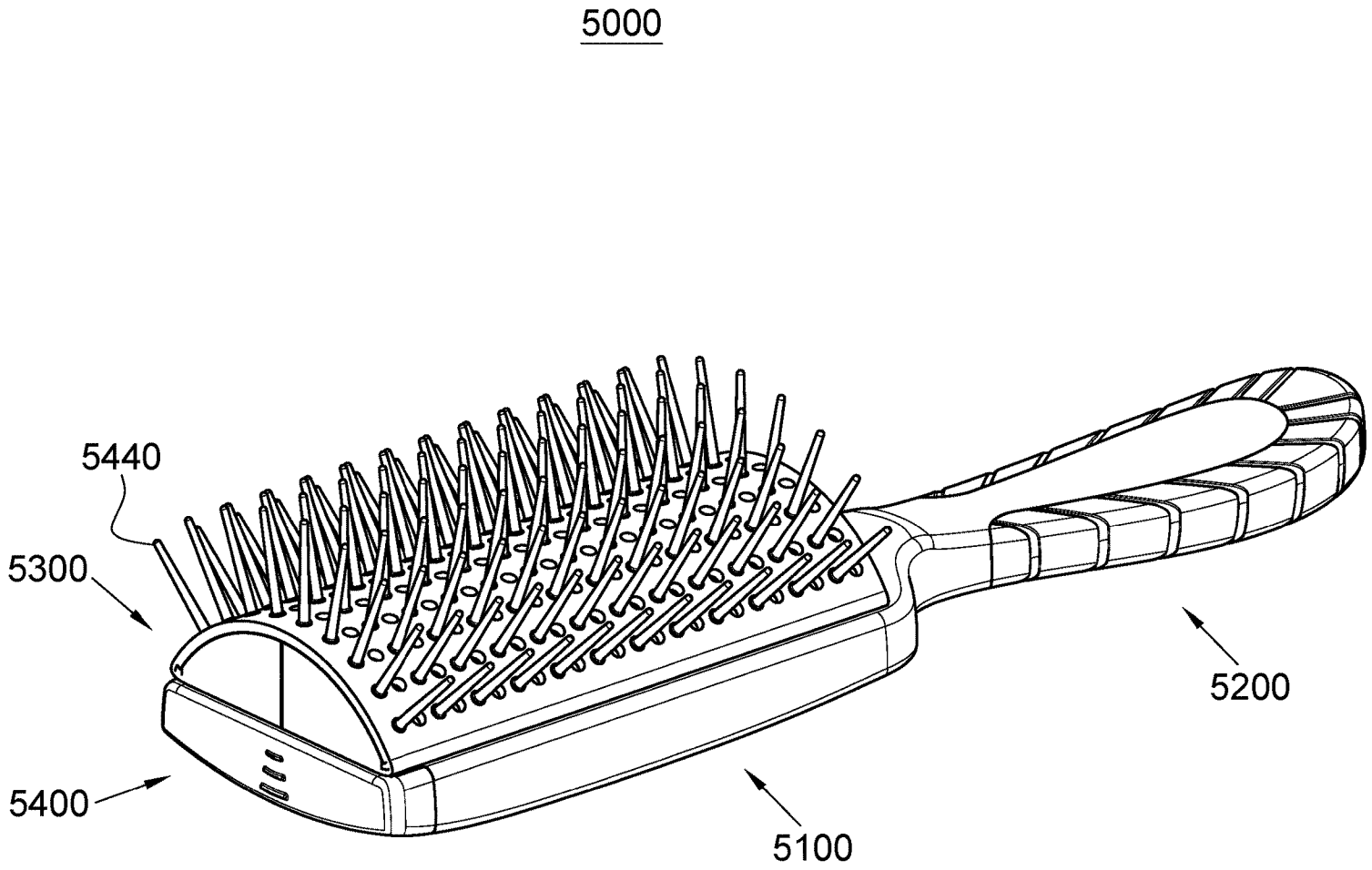
FIG. 19 is a perspective view illustrating a hairbrush according to an exemplary embodiment of the present invention.

FIG. 19 illustrates a hairbrush loaded with a single bristle bar in each row of openings.

Referring to FIG. 19, a hairbrush 5000 may include a head portion 5100, a handle portion 5200 extending from the head portion 5100, a cushion 5300 selectively connected to the head portion 5100, and an end cap 5400 selectively connected to the head portion 5100. As can be seen with reference to FIG. 19, only one bristle bar is loaded in each row of openings of the cushion 5300. This is discernible because every other opening in each row of bristle openings in the cushion 5300 is left unoccupied. However, as can be seen with reference to FIG. 19, each bristle bar occupies the entire length of each respective row with bristle elements 1540.

Figure 20:
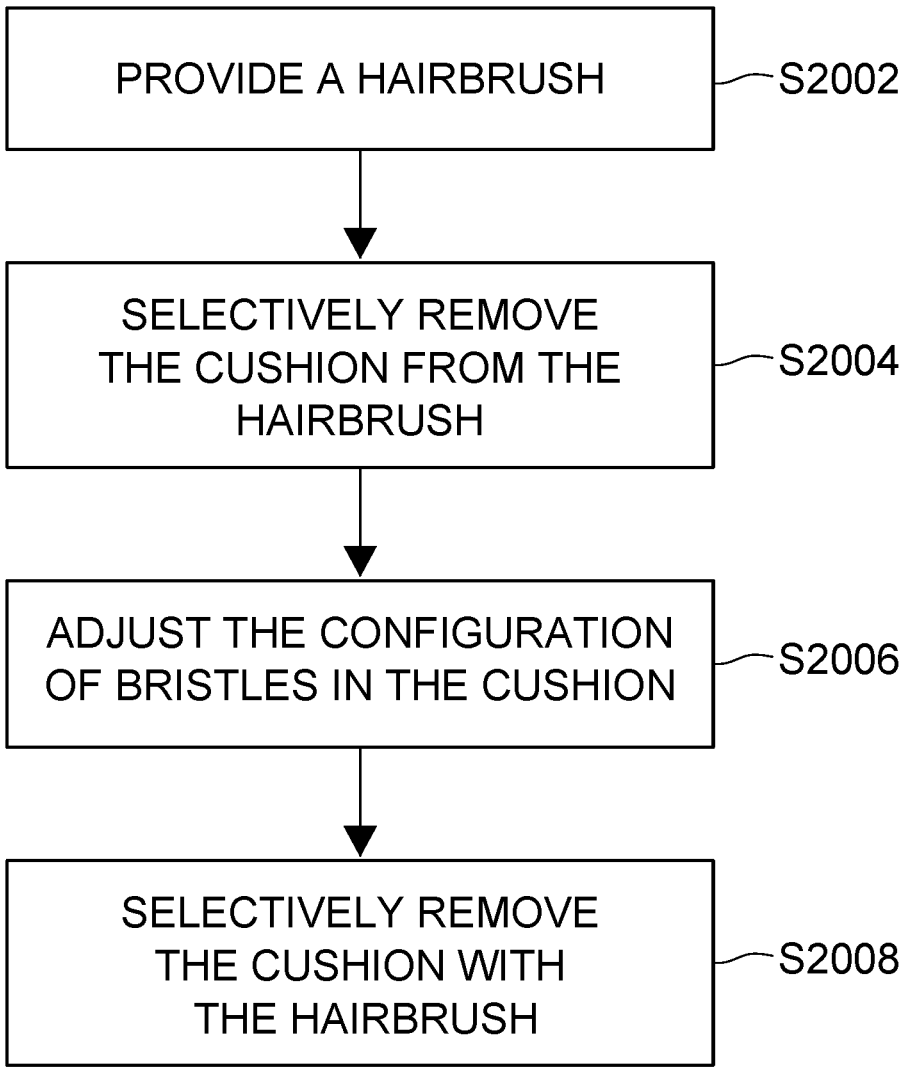
FIG. 20 is a diagram illustrating a method of customizing a hairbrush of the present invention.

FIG. 20 illustrates a method of customizing a hairbrush of the present invention. Referring to FIG. 20 operation S2002 includes providing a hairbrush. The hairbrush of operation S2002 is a hairbrush as described above. Operation S2002 may also include providing one or more bristle bars as described above.

Referring to FIG. 20, operation S2004 includes selectively removing the cushion from the hairbrush. This can be done by removing an end cap, when an end cap is provided with the hairbrush, and removing the cushion from the hairbrush as described above. For example, operation S2004 may include sliding the cushion out of the head portion of the hairbrush.

Referring to FIG. 20, operation S2006 includes adjusting the configuration of the bristles in the cushion as needed. Operation S2006 may include adding and/or removing bristle bars to the various different rows of openings of the cushion as described above. In more detail, operation S2006 includes selecting bristle bars that are suitable for a user's hair or a client's hair, combining the bristle bars as needed by, for example, leaving one or more rows of bristle openings in the cushion empty, placing a particular bristle bar in a particular row of the cushion (or in more than one row), and/or placing pairs of bristle bars (whether with the same or different bristle elements) in one or more rows of the cushion. This may be done by opening the cushion as illustrated in FIG. 8 in order to facilitate the insertion and removal of the bristle bar(s) in each row of openings.

Referring to FIG. 20, operation S2008 includes selectively coupling the cushion with the hairbrush. In other words, after the cushion is loaded with bristle bars as needed, a user may close the cushion (as illustrated in FIG. 5 but with bristle bar(s) loaded) and may couple the loaded cushion with the head portion of the hairbrush. This may include, for example, aligning elongated grooves of the cushion with the protrusions of the head portion, and sliding the cushion toward an end wall of the head portion (see end wall 1140 in FIG. 4), as described above.

While the present invention has been particularly shown and described with reference to exemplary embodiments thereof, it will be apparent to those of ordinary skill in the art that various changes in form and detail may be made therein without departing from the spirit and scope of the present invention as defined by the following claims.

What is claimed is:

1. A hairbrush, comprising:

a head portion;

a cushion selectively connected to the head portion, the cushion including an upper portion with a first row of bristle openings extending therethrough;

a first bristle bar including an elongated base, disposed between the upper portion of the cushion and the head portion of the hairbrush, and a plurality of bristle elements arranged in a row and spaced apart from one another along a length of the elongated base, wherein each bristle element of the first bristle bar extends from the base, through a different opening in the first row of bristle openings, in a direction away from the head portion of the hairbrush, and wherein the bristle elements of the first bristle bar are arranged such that one or more bristle openings in the first row of bristle openings are left unoccupied between a pair of neighboring bristle elements of the plurality of first bristle elements.

2. The hairbrush of claim 1, further comprising a second bristle bar including an elongated base, disposed between the upper portion of the cushion and the head portion of the hairbrush, and the plurality of bristle elements arranged in the row and spaced apart from one another along the length of the elongated base of the second bristle bar, wherein each bristle element of the second bristle bar extends from the base of the second bristle bar, through a different opening in the first row of bristle openings that is not occupied by the plurality of bristle elements of the first bristle bar, in the direction away from the head portion of the hairbrush.

3. The brush of claim 2, wherein the bristle elements of the first bristle bar are alternatively arranged with the bristle elements of the second bristle bar along the first row of bristle openings.

4. The brush of claim 2, wherein the first and second bristle bars are disposed adjacent to one another along their respective lengths.

5. The brush of claim 4, wherein the base of each of the first and second bristle bars includes a plurality of alternating protrusions and indentations along its respective length, wherein the protrusions and indentations of the first bristle bar are selectively interlocked with the protrusions and indentations of the second bristle bar.

6. The brush of claim 5, wherein the bristle elements of the first bristle bar extend from the protrusions of the base of the first bristle bar, and the bristle elements of the second bristle bar extend from the protrusions of the base of the second bristle bar.

7. The brush of claim 4, wherein the base of the first bristle bar includes a plurality of alternating protrusions and indentations along its length, the base of the second bristle bar includes the plurality of alternating protrusions and indentations along its length, and wherein a size of one of the protrusions of the first bristle bar is substantially equal to a size of a corresponding indentation of the second bristle bar such that the first and second bristle bars form an interference fit with one another.

8. The brush of claim 2, wherein a first bristle element of the plurality of bristle elements of the first bristle bar includes a first bristle, and a second bristle element of the plurality of bristle elements of the second bristle bar includes a second bristle different from the first bristle.

9. The brush of claim 1, further comprising a third bristle bar, wherein the upper portion of the cushion further includes with a second row of bristle openings extending therethrough, the first and second rows of bristle openings being spaced apart from one another, wherein the third bristle bar includes the elongated base, disposed between the upper portion of the cushion and the head portion of the brush, and the plurality of bristle elements arranged in the row and spaced apart from one another along a length of the elongated base of the third bristle bar, wherein each bristle element of the third bristle bar extends from the base of the third bristle bar, through a different opening in the second row of bristle openings, in the direction away from the head portion of the hairbrush, and wherein the plurality of bristle elements of the third bristle bar, as a collective group, occupy every other opening in the second row of bristle openings.

10. The brush of claim 9, further comprising a fourth bristle bar including the elongated base, disposed between the upper portion of the cushion and the head portion of the hairbrush, and the plurality of bristle elements arranged in the row and spaced apart from one another along a length of the elongated base of the fourth bristle bar, wherein each bristle element of the fourth bristle bar extends from the base of the fourth bristle bar, through the different opening in the second row of bristle openings that is not occupied by the plurality of bristle elements of the third bristle bar, in the direction away from the head portion of the brush.

11. The brush of claim 9, wherein the third and fourth bristle bars are interlocked with one another.

12. The brush of claim 1, wherein a first bristle element of the plurality of bristle elements of the first bristle bar includes a bristle made of a material selected from the group consisting of equine hair, bovine hair, goat hair, donkey hair, mule hair, camel hair, llama hair, boar hair, swine hair, badger hair, mink hair, sable hair, nylon, polyester, polyurethane, PVC, polycarbonate, plant fiber and a feather.

13. The brush of claim 1, wherein a first bristle element of the plurality of bristle elements of the first bristle bar includes a first bristle, and a second bristle element of the plurality of bristle elements of the first bristle bar includes a second bristle different from the first bristle.

14. The brush of claim 1, further comprising a cap selectively connected to the brush head and configured to maintain the cushion selectively connected to the brush head.

15. The brush of claim 1, wherein the cushion further includes a first lower portion hingedly connected to the upper portion of the cushion along a first side of the upper portion, and a second lower portion hingedly connected to the upper portion of the cushion along a second side of the upper portion, opposite to the first side thereof, wherein, when the cushion is selectively connected to the head portion of the hairbrush, the elongated base of the first bristle bar is disposed between the upper portion of the cushion and the first lower portion thereof, or between the upper portion of the cushion and the second lower portion thereof.

16. The brush of claim 15, wherein the head portion of the hairbrush includes an elongated track protruding from a first inner side surface thereof, and the first lower portion of the cushion includes an elongated groove configured to receive the first elongated track therein in order to selectively couple the cushion to the brush head.

17. A method of customizing a hairbrush, the method comprising:

obtaining a first bristle bar; and engaging the first bristle bar with the hairbrush, wherein the hairbrush includes:

a head portion; and a cushion selectively connected to the head portion, the cushion including an upper portion with a first row of bristle openings extending therethrough, wherein the first bristle bar includes an elongated base, disposed between the upper portion of the cushion and the head portion of the hairbrush when the first bristle bar is engaged with the hairbrush, and a plurality of bristle elements arranged in a row and spaced apart from one another along a length of the elongated base of the first bristle bar, wherein, when the first bristle bar is engaged with the hairbrush, each bristle element of the first bristle bar extends from the base, through a different opening in the first row of bristle openings, in a direction away from the brush head, and wherein, when the first bristle bar is engaged with the hairbrush, the bristle elements of the first bristle bar are arranged such that one or more bristle openings in the first row of bristle openings is left unoccupied between a pair of neighboring bristle elements of the first bristle bar.

18. The method of claim 17, further comprising the steps of:

obtaining a second bristle bar; and engaging the second bristle bar with the hairbrush, wherein the second bristle bar includes the elongated base and the plurality of bristle elements arranged in the row and spaced apart from one another along a length of the elongated base of the second bristle bar, each bristle element of the second bristle bar extending from the base of the second bristle bar.

19. The method of claim 18, wherein the step of engaging the second bristle bar with the brush includes inserting the bristle elements of the second bristle bar through the first row of bristle openings of the cushion that are not occupied by the bristle elements of the first bristle bar with each bristle element of the second bristle bar extending through the different opening in the first row of bristle openings.

20. The method of claim 18, wherein the cushion further includes a second row of bristle openings spaced apart from the first row of bristle openings, and wherein the step of engaging the second bristle bar with the brush includes inserting the bristle elements of the second bristle bar through the second row of bristle openings of the cushion such that each bristle element of the second bristle bar extends through a different opening in the second row of bristle openings, and wherein the plurality of bristle elements of the second bristle bar, as a collective group, occupy every other opening in the second row of bristle openings.

* * * * *